US006438989B1

(12) United States Patent
Wolski et al.

(10) Patent No.: US 6,438,989 B1
(45) Date of Patent: Aug. 27, 2002

(54) JUICE DISPENSER WITH REMOVABLE COOLED CABINET

(75) Inventors: Peter F. Wolski, Algonquin; Michael S. Long, Wauconda; William W. Segiet, Jr., Chatham, all of IL (US)

(73) Assignee: IMI Cornelius Inc., Anoka, MN (US)

( * ) Notice: Subject to any disclaimer, the term of this patent is extended or adjusted under 35 U.S.C. 154(b) by 0 days.

(21) Appl. No.: 09/696,513

(22) Filed: Oct. 25, 2000

Related U.S. Application Data

(60) Provisional application No. 60/161,498, filed on Oct. 26, 1999.

(51) Int. Cl.[7] ..... B67D 5/62

(52) U.S. Cl. ..... 62/390; 62/299; 62/392; 62/393; 62/399

(58) Field of Search ..... 62/390, 392, 393, 62/396, 399, 299; 222/146.6

(56) References Cited

U.S. PATENT DOCUMENTS

| | | | | |
|---|---|---|---|---|
| 4,226,606 A | * | 10/1980 | Yaeger et al. | 62/299 |
| 5,279,446 A | * | 1/1994 | Cook et al. | 222/146.6 |
| 5,419,461 A | * | 5/1995 | gOULET | 222/146.6 |
| 5,797,519 A | * | 8/1998 | Schroeder et al. | 222/146.6 |

* cited by examiner

*Primary Examiner*—William E. Tapolcai
*Assistant Examiner*—Mohammad M Ali

(74) *Attorney, Agent, or Firm*—Sten Erik Hakanson

(57) ABSTRACT

A juice dispenser is shown that includes a water bath tank, a mechanical refrigeration system and a beverage containing cabinet. These three primary components are designed to be separable modular units that are easily assembled together and disassembled. A sheet metal refrigeration deck having an evaporator secured thereto and suspended there below is dropped into and secured to a top end of a water bath tank. Various mechanical refrigeration components including primarily a compressor and condenser, are supported above the deck at a rear portion thereof. The beverage cabinet is positioned and retained above a forward portion of the water bath tank and includes an internal space for retaining a beverage container for holding typically a volume of beverage or juice concentrate/syrup. Fluid disconnects provide for releasable connection with the water bath for providing fluid connection to a heat exchange coil located in the cabinet to provide cooling therein, and hence, cooling of the concentrate. A fluid disconnect is also provided for a line delivering cooled potable water to beverage dispensing valves secured externally of and to the cabinet. The valves combine the water with the beverage concentrate for preparing and dispensing the finished drink. The present invention provides for the advantage of being able to quickly disengage the fluid lines extending between the water bath and the concentrate cabinet so that those two primary components can be easily separated and worked on. Further quick disconnects permit the refrigeration deck to be lifted from and off the water bath tank to further aid is servicing either the water bath or refrigeration components.

4 Claims, 5 Drawing Sheets

10

12
52
50
11b
28
48
47
14
43a
43
56
24
26

52
50
48
16
12
77
75
76
74
80
47
70
66a
64
62
46
60
56
66
70
11b
58c
68
58b
72
58
58a
24

JUICE DISPENSER WITH REMOVABLE COOLED CABINET

This application claims benefit of Provisional No. 60/161,498 filed Oct. 26, 1999.

FIELD OF THE INVENTION

The present invention relates generally to juice dispensers, and more particularly to juice dispensers that are easily serviced.

BACKGROUND OF THE INVENTION

Juice dispensers for reconstituting fruit or vegetable juice syrup concentrate with water and dispensing the reconstituted juice into a cup, are well known in the prior art. Generally, a juice dispensing apparatus includes one or more post-mix valves that operate to mix independent inflows of potable water and juice concentrate, control the ratios thereof and dispense the finished product into a cup. Mechanically refrigerated juice dispensers are known that include a water bath system. In such a system, an evaporator is placed in a water bath tank for the formation of an ice bank thereon. The ice bank water bath provides for a cooling reserve and is used to separately cool the potable water before it is combined with the juice concentrate. Specifically, the potable water flows through heat exchange lines located in the water bath and is cooled thereby prior to its combination with the syrup at the dispensing valve.

It is also known to cool the concentrate prior to its combination with the water. Typically, the concentrate is contained within a flexible bag or rigid plastic container from which the concentrate is pumped to the post-mix valve. The concentrate reservoir is held within a dedicated compartment in the dispenser housing. That compartment can be cooled by the circulation of cold water from the water bath through heat exchange coils in the concentrate compartment.

A problem with juice dispensers of the type described above concerns the ease of service thereof. If, for example, a problem involves the water bath components, service thereof can involve a time consuming disassembly of the entire dispenser. Accordingly, it would be very desirable to have a juice dispenser that provides all the advantages of a water bath for cooling the potable water as well as the concentrate compartment, but that is easier to repair, and therefore, less costly to own and maintain.

SUMMARY OF THE INVENTION

The present invention concerns a juice dispenser that includes a water bath tank, a mechanical refrigeration system and a cooled beverage containing compartment or cabinet. These three major components thereof are designed to be separable modular units that are easily assembled together and disassembled. A sheet metal refrigeration deck having an evaporator secured thereto and suspended there below is easily dropped into and secured to a top end of the water bath tank. Various mechanical refrigeration components including primarily a compressor and condenser are supported above the deck at a rear portion thereof. The cooled cabinet is positioned and retained above a forward portion of the water bath tank.

Quick fluid disconnects provide for releasable connection with water lines extending from the water bath for providing fluid connection to a heat exchange coil located within an internal beverage containing space in the cabinet. One or more beverage containers are retained within this space and cooled by heat exchange convection with the heat exchanger. The beverage containers are fluidly connected to beverage dispense valves externally secured to and suspended from a lower end of the cabinet. A quick fluid disconnect is also provided for a line delivering cooled potable water to the beverage dispensing valves. The potable water is used to combine with the juice syrup for reconstituting the dispensed drink. Thus, the present invention provides for the advantage of being able to quickly disengage the three fluid lines extending between the water bath and the concentrate compartment so that those two primary components can be easily separated and worked on. Those of skill will appreciate that various juice retaining cabinets can be made that are the same externally but adapted differently internally as to the type of juice container that can be retained therein. Thus, the present invention easily facilitates such exchange of cabinets while permitting the use of the same refrigeration components. Further quick disconnects permit the refrigeration deck to be lifted from and off the water bath tank to also aid is servicing either the water bath or refrigeration components.

DESCRIPTION OF THE DRAWINGS

A better understanding of the structure, function, operation and advantages of the present invention can be had by referring to the following detailed description which refers to the following drawing figures, wherein.

DETAILED DESCRIPTION OF THE PREFERRED EMBODIMENT

Figure 1:
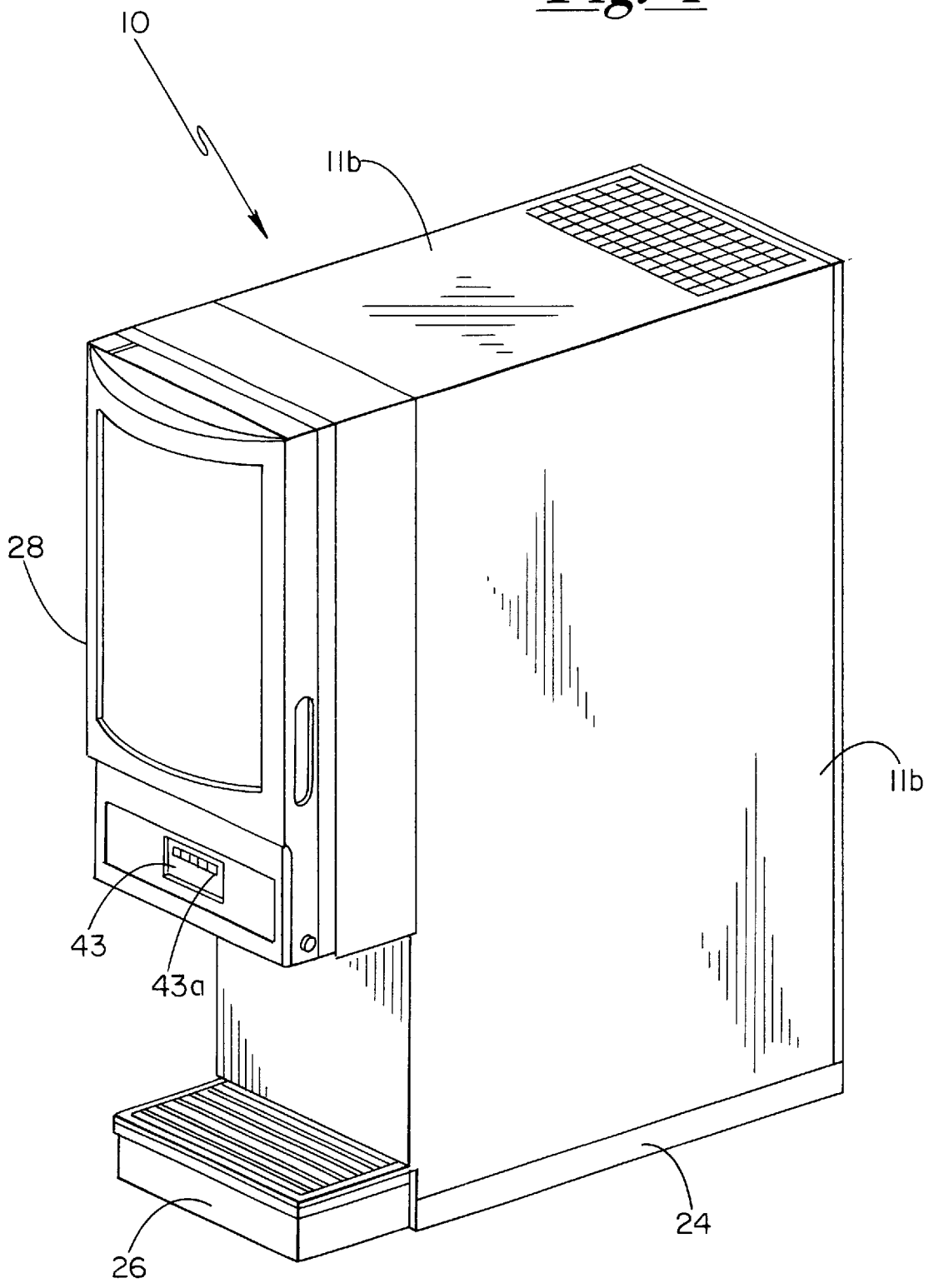
FIG. 1 shows a perspective view of the present invention.
Figure 2:
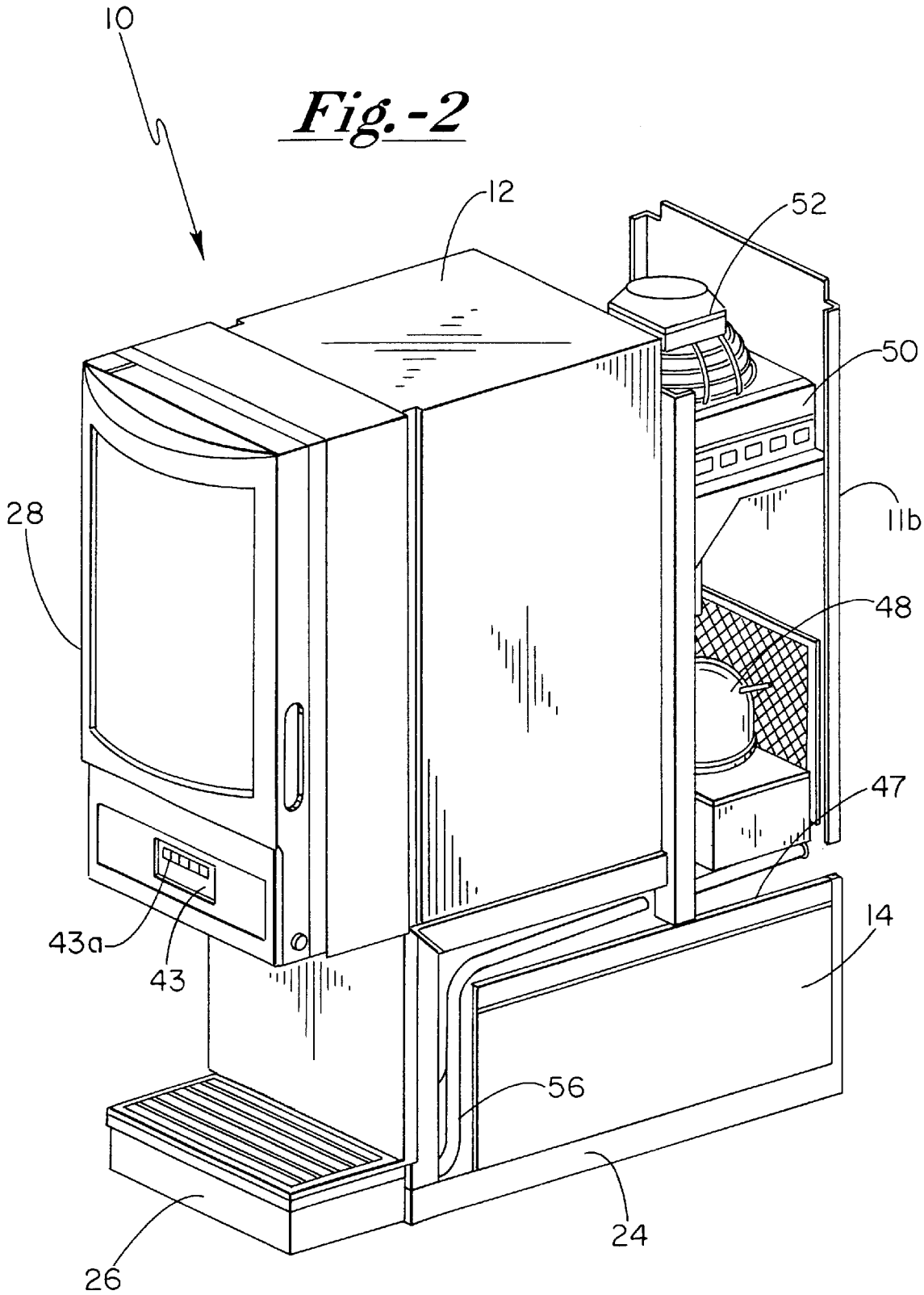
FIG. 2 shows a further perspective view of the present invention.
Figure 3:
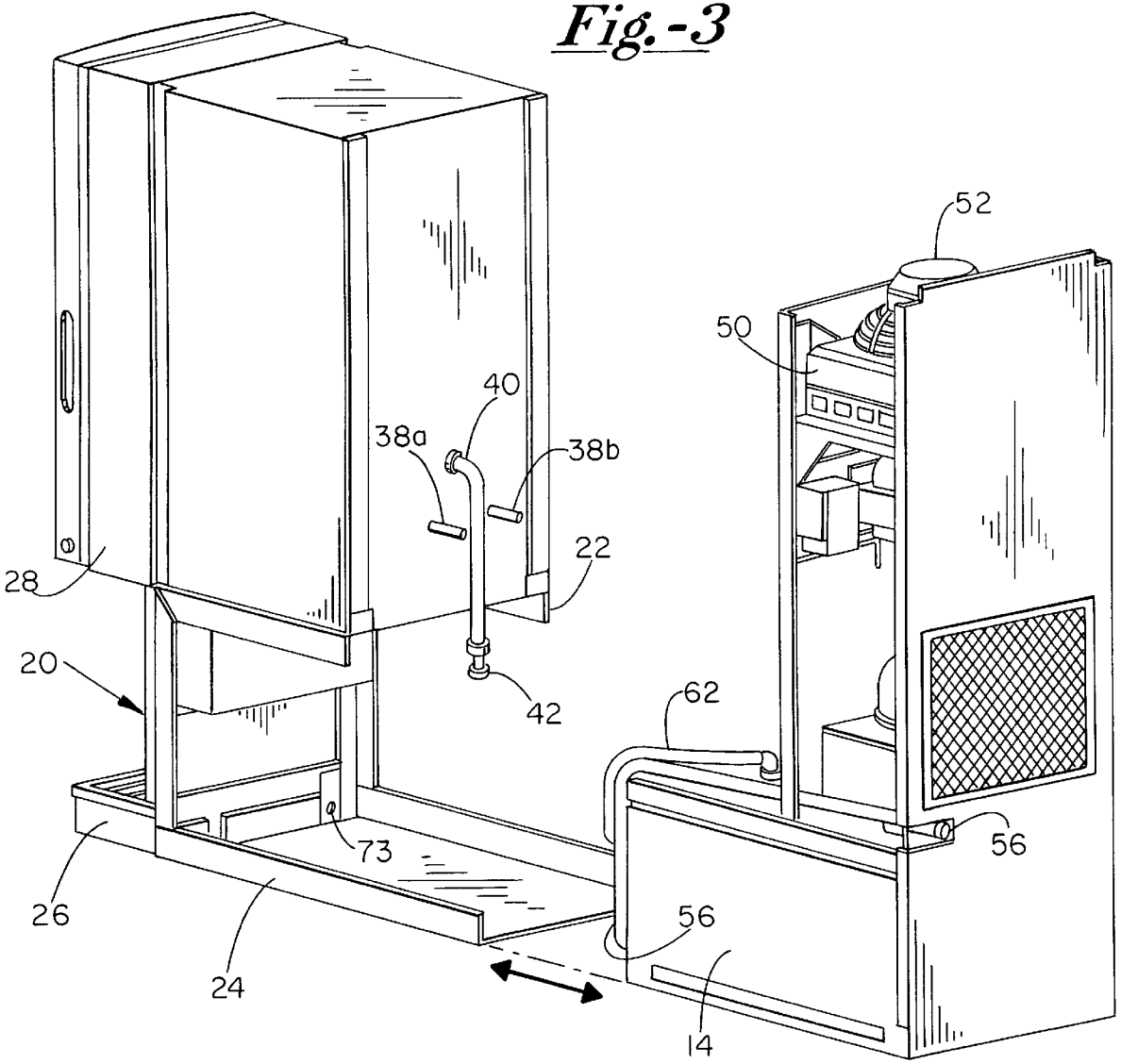
FIG. 3 shows a further perspective view of the present invention with the refrigeration deck and water bath combination separated from the juice concentrate compartment.
Figure 4:
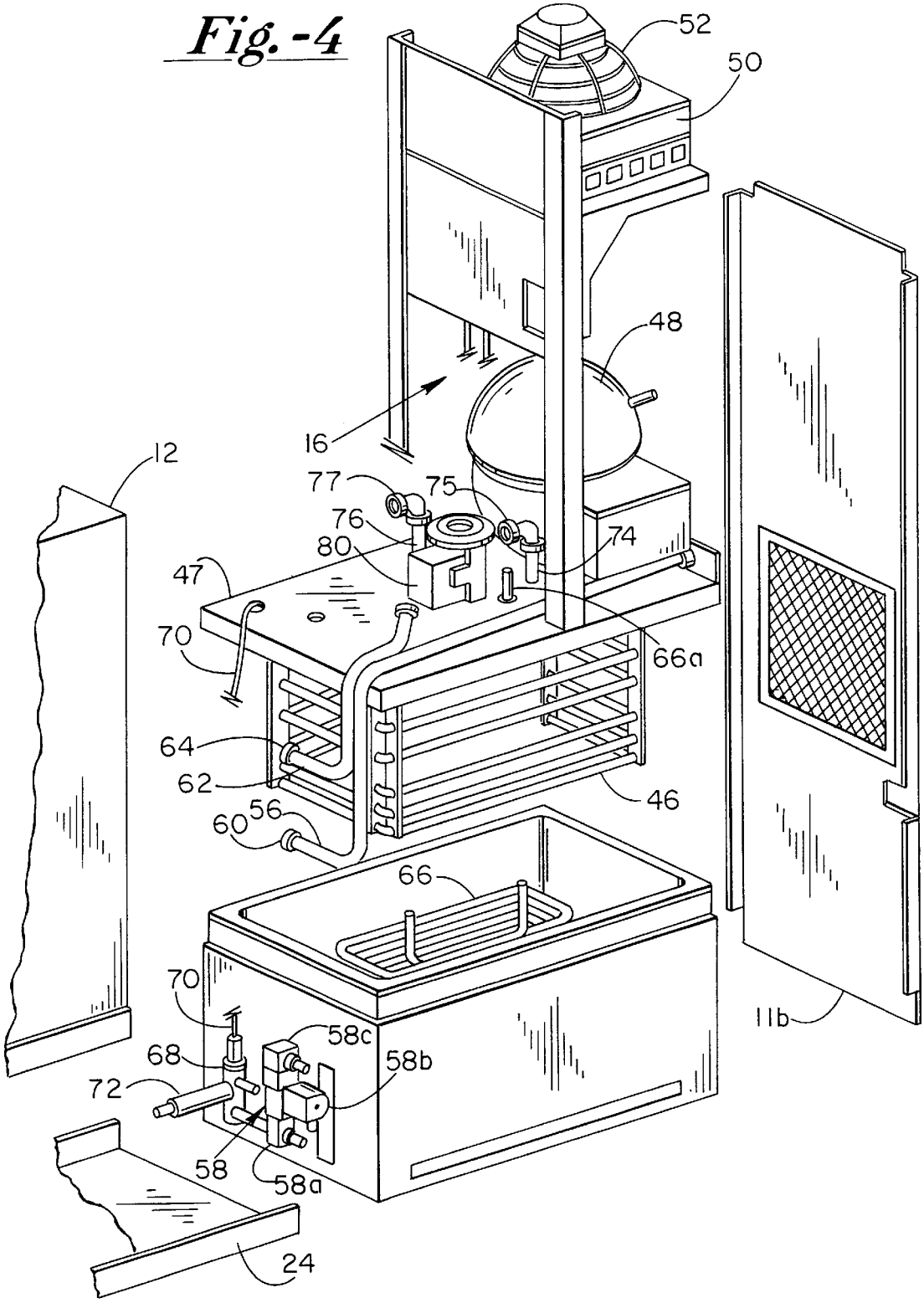
FIG. 4 shows an enlarged exploded view of the present invention.

The juice dispenser of the present invention is seen in the various figures and generally referred to by the numeral 10. As seen by comparing FIGS. 1 and 2, various side and top panels 11*a* and 11*b* can be removed from dispenser 10 revealing that it is comprised of three main sections or portions, namely a cooling cabinet 12, a water bath tank 14 and a refrigeration system 16. As seen by also referring to FIGS. 3 and 4, frame 20 includes a top end 22 for supporting compartment 12 and a lower shelf 24 for defining a tank receiving area for slidingly receiving tank 14 thereon and therein. A drip tray 26 is secured to frame 20 and is positioned below an access door 28 of compartment 12.

Figure 5:
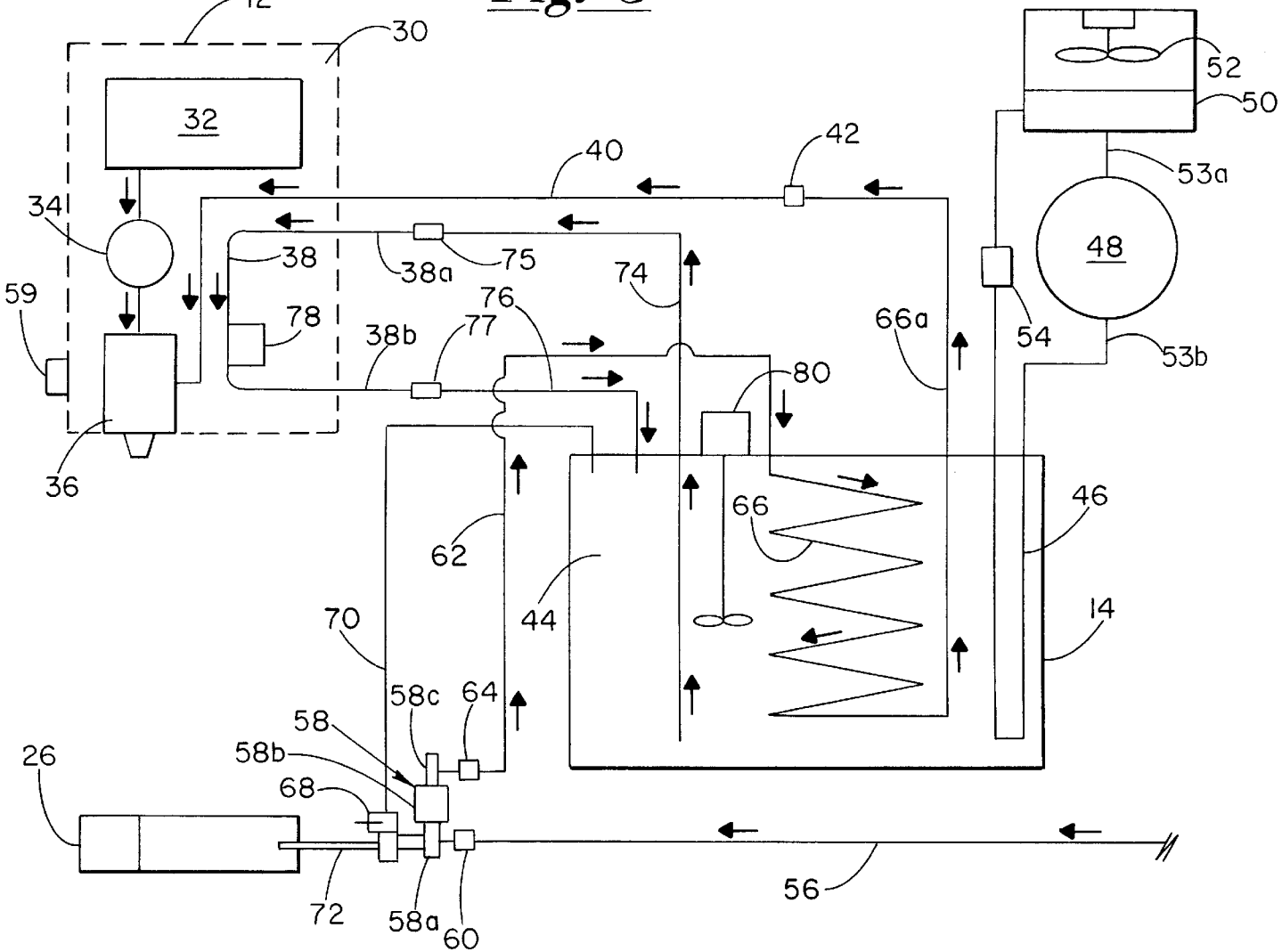
FIG. 5 shows a schematic diagram of the present invention.

As understood by also referring to FIG. 5, and as is known in the art, compartment 12 includes an interior space 30 for retaining therein a juice concentrate reservoir 32, such as a flexible pouch. A pump 34 is also positioned in the cabinet and a dispensing valve 36 is secured thereto and externally thereof above the drip tray 26. A heat exchange coil 38 is located in interior space 30 and includes inlet and outlet tube ends 38*a* and 38*b* extending from a back end of compartment 12. A flexible hose 40 is fluidly connected to valve 36 and has an inlet end that also extends from compartment 12 and includes an fluid uncoupling means comprising a quick fluid connect/disconnect fitting 42. Such quick fluid connect/disconnect fittings are well known in the art and are preferably of the type manufactured, for example, by IMI Norgren of Littleton, Colo. or John Guest USA, Inc. of Pinebrook, N.J. As is well known in the art, there typically exists one pump for each dispensing valve for each concentrate reservoir. Thus, where the dispenser herein includes more than one such container 32, cabinet 12 will retain an equal plurality of pumps 34 and valves 36. As is also well understood, pumps 34 can be of the peristaltic type, and control panel 43 on door 28 includes one or more switches 43*a* for selectively operating one of the pumps 34 when dispensing of a particular beverage is desired.

As seen in FIG. 5, tank 14 includes an interior water bath area 44 for retaining therein a volume of water. As is known in the art, an evaporator 46, suspended below a sheet metal deck 47, provides for cooling of the water bath through the formation thereon of an ice bank. Cooling of evaporator 46 is accomplished by a mechanical refrigeration system including a compressor 48, a condenser 50, a condenser fan 52, high and low pressure refrigerant lines 53*a* and 53*b* respectively and an expansion valve 54. A frame 55 is secured to deck 47 and tank 14 provides for supporting condenser 50 and fan 52 there above.

Potable water flows from a pressurized source thereof through a water line 56 to an inlet 58*a* of distribution block 58 and is coupled thereto by a quick fluid disconnect 60 of the type mentioned herein above. Block 58 includes a solenoid operated valve 58*b* for regulating fluid flow to an outlet 58*c*. A water inlet line 62 is coupled to outlet 58*c* by a further quick fluid disconnect 64 and extends to and is fluidly connected to an inlet end of a water cooling coil 66 submerged in the water bath of tank 14. Inlet 58*a* is fluidly connected to a manually operable valve 68. Valve 68 regulates flow along fill line 70 that provides for filling of tank 14 at the startup of dispenser 10. A rigid water bath tank over flow tube 72 provides for sliding sealing insertion into a hole, 73, in drip tray 26 wherein, after filling of tank 14 and closure of valve 68, line 70 serves as an water bath overflow conduit. An outlet end 66*a* of coil 66 is securable to water line 40 by quick fluid disconnect 42. A supply water line 74 is fluidly connectable by a quick fluid disconnect 75 to inlet end 38*a* of coil 38 and a return line 76 is fluidly connectable by a further quick fluid disconnect 77 to outlet coil end 38*b*. Lines 74 and 76 provide fluid communication between water bath 14 and coil 38. A combination pump agitator motor 80 provides for circulation of cold water from water bath 14 through coil 38 in the direction of the arrows as indicated in FIG. 5, and provides for circulation of the water in bath 14 to maximize the heat exchange effectiveness thereof. Lines 74 and 76 preferably comprise flexible plastic tube portions for facilitating their connection to coil ends 38*a* and 38*b*.

In the dispensing operation of the present invention, manual valve 68 provides for filling of bath 14 with water along line 70. The refrigeration system can then cool evaporator 46 for forming an ice bank thereon. Pump 78 operates to pass the cooled non-potable bath water through coil 38 thereby providing, by heat exchange convection, for cooling of the interior 30 of compartment 12, and hence, the juice concentrate within reservoir 32. Actuation of a switch 43*a* causes the operation of pump 34 and the opening of valve 36 and 58 so that juice concentrate and potable water flow to and from valve 36. As is known, the rate of operation of a pump 34 and a water flow control of valve 36 provide for mixing the juice and water components at the desired ratio for dispensing of the finished drink there from.

As can be understood by those of skill, the present invention provides for quick assembly and disassembly thereof. Quick fluid disconnects 42, 75 and 77 provide for uncoupling of lines 40, 74 and 76 respectively. Thus, tank 14 can be disconnected from compartment 12 as a single unit and separated there from. Rigid tube 72 also permits such disassembly in that overflow drain tube 72 simply inserts into drip tray 26 as opposed to, for example, having a clamped hose connection there between. This disassembly approach, of course, also permits the assembly of tank 14 and refrigeration deck 47 separately after which those major components can brought together and then assembled with compartment 12 by reversal of their disassembly as outlined above. It can also be appreciated by those of skill that deck 47 on or to which the various refrigeration components and agitator motor 80 are secured, can be lifted from tank 14 after the removal of securing means, not shown, such as screws or quick disconnect pins. This fast removal of deck 16 is permitted by the further fluid disconnects 60 and 64. The position of the bath tank 14 below the concentrate compartment and occupying the bottom of dispenser 10 permits a relatively large bath volume extending from the front to the rear of dispenser 10. Positioning the refrigeration components at the rear of the dispenser 10 to and above deck 47 permits an efficient layout thereof with vertical space for separating condenser 50 and compressor 48. Moreover, this L-shaped configuration creates a forward portion of water bath 14 above which cabinet 12 can be positioned and secured. In addition, heat produced by those refrigeration components will have less of a tendency to negatively impact cabinet 12 than if such were placed there below. Of course, water bath 14 will have little if any negative heat impact on cabinet 12.

The present disclosure includes that contained in the appended claims as well as that of the foregoing description. Moreover, although this invention has been described with a certain degree of particularity, it is understood that the present disclosure of the invention has been made only by way of example. Those of skill can appreciate that various changes and modifications can be made to the embodiment of the present invention disclosed herein relative to the combination, arrangement and selection of parts without departing from the spirit and scope of thereof.

What is claimed is:

1. A beverage dispenser, comprising:

a cabinet having an internal space for retaining therein one or more beverage containers holding a quantity of a beverage and the cabinet including one or more beverage dispensing valves in fluid communication with the one or more beverage containers and including one or more beverage pumps for pumping the beverage from a container to a respective valve, a heat exchange coil located in the cabinet internal space and having inlet and outlet ends extending from the cabinet, a water bath tank for retaining a volume of water therein and having an evaporator suspended therein, a refrigeration system for cooling the evaporator, and the water bath tank, refrigeration system and cabinet securable together forming an integral unit, a supply line extending from the water bath for delivering water to the heat exchange coil by the operation of a pump and a return line for returning the water pumped to the heat exchange coil back to the water bath and the supply and return lines each having means for permitting releasable connecting with the heat exchange coil inlet and outlet respectively for facilitating separation of the cabinet from the water bath tank and refrigeration system.

2. The dispenser as defined in claim 1, and the compressor and condenser positioned at and above a rear portion of the water bath tank and the cabinet secured to and above a forward portion of the water bath tank.

3. A beverage dispenser, comprising:

a cabinet having an internal space for retaining therein one or more beverage containers each holding, a quantity of a beverage and the cabinet including one or more beverage dispensing valves in fluid communication with the one or more beverage containers and including one or more beverage pumps for pumping the beverage from a container to a respective valve, a heat exchange coil located in the cabinet internal space and having inlet and outlet ends extending from the cabinet, a water bath tank for retaining a volume of water therein and having an evaporator suspended therein, a refrigeration system for cooling the evaporator, and the water bath tank, refrigeration system and cabinet securable together forming an integral unit, a supply line extending from the water bath tank for delivering water to the heat exchange coil by the operation of a water pump and a return line for returning the water pumped to the heat exchange coil back to the water bath tank, a water cooling coil suspended in the water bath tank having an inlet end thereof for connecting to a source of potable water and an outlet end thereof connectable to a diluent line, the diluent line connected to the one or more valves, and the supply and return lines each having means for permitting releasable fluid connecting with the heat exchange coil inlet and outlet respectively and the water cooling coil and the diluent line also having means for providing releasable fluid connecting there between so that said releasable fluid connecting means provide for facilitating separation of the cabinet from the water bath tank and refrigeration system.

4. The dispenser as defined in claim 3, and the compressor and condenser positioned at and above a rear portion of the water bath tank and the cabinet secured to and above a forward portion of the water bath tank.

* * * * *